United States Patent [19]

Sykes et al.

[11] 4,191,575

[45] Mar. 4, 1980

[54] TWO-STEP PHOTOGRAPHIC PROCESSING OF BLACK AND WHITE IMAGES WHICH ENHANCES THE IMAGES BY CONTROLLED BLEACHING DURING FIXING IMMEDIATELY FOLLOWING DEVELOPMENT AND WHICH PRODUCES BLACK AND WHITE IMAGES WITH REDUCED DENSITY IN LOW DENSITY AREAS

[75] Inventors: Donald J. Sykes, Upper Saddle River; Louis D. Pratt, North Bergen, both of N.J.

[73] Assignee: Philip A. Hunt Chemical Corp., Palisades Park, N.J.

[21] Appl. No.: 711,139

[22] Filed: Aug. 3, 1976

Related U.S. Application Data

[63] Continuation of Ser. No. 312,828, Dec. 7, 1972, abandoned.

[51] Int. Cl.[2] ..... G03C 5/32; G03C 5/30

[52] U.S. Cl. ..... 430/418

[58] Field of Search ..... 96/63, 50, 60, 59, 66, 96/61

[56] References Cited

U.S. PATENT DOCUMENTS

| | | | |
|---|---|---|---|
| 712,313 | 10/1902 | Krieger | 96/60 R |
| 816,751 | 5/1905 | Smith | 96/60 R |
| 1,014,970 | 1/1912 | McCurdy | 96/59 |
| 1,950,903 | 3/1934 | Murray | 96/60 R |
| 3,617,283 | 11/1971 | Ohi | 96/60 BF |
| 3,762,923 | 10/1973 | Sugiyama et al. | 96/63 |

*Primary Examiner*—Mary F. Kelley

*Attorney, Agent, or Firm*—Kirschstein, Kirschstein, Ottinger & Cobrin

[57] ABSTRACT

A two-step black and white photographic process in which conventional black and white developing of latent images in a silver halide black and white emulsion first is carried out and then, instead of simply fixing the developed emulsions containing black and white images, the emulsions are fixed and bleached concurrently for a short period of time long enough to perform the fixing and to enable a controlled mild degree of bleaching to occur. Such bleaching is carried out only for a time long enough selectively to attack low-density areas of freshly developed black and white images at a greater rate than areas of heavier density so as to depress the toe of the D log E curve without markedly affecting the balance of the curve, thus enhancing the images by obtaining a general increase of contrast, a reduction or total elimination of fog and a reduction or elimination of film haze, this latter being applicable primarily to radiology. The bleaching/fixing solution contains a standard fixative such as a thiosulfate, a chelated ferric or cobaltic salt capable of bleaching the silver image by oxidation and, optionally, an accelerating agent which accelerates bleaching. The bleaching/fixing solution also contains standard addenda.

8 Claims, No Drawings

TWO-STEP PHOTOGRAPHIC PROCESSING OF BLACK AND WHITE IMAGES WHICH ENHANCES THE IMAGES BY CONTROLLED BLEACHING DURING FIXING IMMEDIATELY FOLLOWING DEVELOPMENT AND WHICH PRODUCES BLACK AND WHITE IMAGES WITH REDUCED DENSITY IN LOW DENSITY AREAS

CROSS-REFERENCE TO RELATED APPLICATION

This application is a continuation of application Ser. No. 312,828 filed Dec. 7, 1972 now abandoned, for TWO-STEP PHOTOGRAPHIC PROCESSING OF BLACK AND WHITE IMAGES WHICH ENHANCES THE IMAGES BY CONTROLLED BLEACHING DURING FIXING IMMEDIATELY FOLLOWING DEVELOPMENT AND WHICH PRODUCES BLACK AND WHITE IMAGES WITH REDUCED DENSITY IN LOW DENSITY AREAS.

BACKGROUND OF THE INVENTION

1. Field of the Invention

A two-step black and white photographic process in which the developed image is enhanced by controlled bleaching during fixing immediately following development.

2. Description of the Prior Art

The method presently most widely used in black and white photographic processing of latent images in black and white silver halide negative and positive emulsions is a two-step process, in the first step of which a conventional black and white developer suitable for the particular emulsion and conditions is employed, and in the second step of which undeveloped silver halide is removed with a conventional fixer such as a thiosulfate. Such two-step black and white photographic process is used, for example, to form photographic black and white negatives, black and white prints, e.g. paper prints, high contrast continuous tone emulsions such as reprographic emulsions, X-ray films and photomechanical reproductions, both line and screened.

In all of such two-step black and white photographic processes a phenomenon known as fog occurs. This is due to the undesirable reduction of unexposed silver halide to metallic silver, principally, in areas which are supposed to be void of metallic silver. The amount of metallic silver that creates fog is not considerable, but the very presence of the fog reduces contrast and, in films which are to be viewed in front of a light, causes haze. The phenomenon of fog has been considered as an undesirable drawback of black and white photographic developing processes. Because of its supposed inherence, it has been accepted despite the disadvantage of its presence. Indeed, a common measurement employed in evaluating emulsions, and various photographic processes and chemicals has been the lowest level of density created in an unexposed emulsion after developing and fixing; this level has been called "base+fog" simply because fog has been accepted as a necessary evil of the photographic process.

Another problem which existed in the art, and this pertained principally to radiographic films, was that the silver metal formed upon development in unexposed areas of the emulsion caused haze which is a different aspect of fog. Fog, per se, is merely an increase in density which can be read with a densitometer. Haze is a diffusion of light noticeable when a transparency is held in front of a light source. Haze gives rise to a halo around the light source because the unwanted metal silver particles diffuse transmitted light.

It would be highly desirable to eliminate or greatly reduce fog and haze. Such reduction would enhance an image by improving contrast generally through lightening of the areas of a developed image which should be unclouded and by eliminating or reducing haze so that when a radiograph is viewed the combination of the reduction in fog and the reduction in haze would enable a radiologist to far more readily inspect a radiograph and observe details which heretofore were somewhat fuzzy and could have led to doubtful and even erroneous diagnoses.

SUMMARY OF THE INVENTION

1. Purposes of the Invention

It is an object of the invention to provide a two-step method of black and white photographic processing which enhances a developed and fixed image by increasing contrast for all types of silver halide black and white emulsions, reducing or substantially eliminating film base haze, particularly for radiology.

It is another object of the invention to provide a two-step method of the character described which achieves the aforesaid desirable results by controlled bleaching during fixing immediately after developing.

It is another object of the invention to provide a photographic processing technique of the character described which does not noticeably affect the density of darker areas of a developed and fixed image.

It is another object of the invention to provide a photographic processing technique of the character described in which the density of a developed and fixed image is reduced by a controlled bleaching fixing step that takes place on the heels of developing, and bleaches the lower density areas selectively at a greater rate than the areas of heavier density.

It is another object of the invention to provide a photographic processing technique of the character described which depresses the toe of the D log E curve without materially affecting the balance of the curve.

Other objects of the invention in part will be obvious and in part will be pointed out hereinafter.

2. Brief Description of the Invention

In general, the present invention is carried out by practicing a two-step black and white photographic process in which the first step constitutes black and white developing with a standard black and white developer that conventionally is employed with the type of black and white emulsion being processed and under the prevailing conditions. Thus, with a home or studio photographic continuous tone negative a standard photographic black and white negative developing bath would be used. For the developing of a black and white home or studio photographic print a conventional home or studio photographic black and white print developer would be used. Similarly, different but standard developers would be used for reprographic developing, X-ray developing and lithographic developing, However, instead of using a conventional fixing bath in a fixing step which follows as soon as the developing step is completed, pursuant to the present invention there is substituted a combination fixing and bleaching bath with the aid of which controlled bleaching takes place. It has been found that this bath, if the bleaching is sufficiently mild and if it occurs over a short enough period of time will bleach low density areas of the developed image at a selective rate which is greater than the rate at which it bleaches areas of heavier density. Since the bleaching takes place concurrently with the fixing, only two steps are necessary for the photographic process. The bleaching rate is adjusted by suitably formulating the bleach/fix bath, including adjusting the concentrations of the constituents thereof, and taking into account all of the other parameters present during the developing and fixing so that the aforesaid selectively higher rate of bleaching attack on areas of low density is accomplished to enhance the image without degrading the image by materially visually reducing the density of the areas of heavier density. The parameters include the concentration of the bleaching agent, the presence or absence of accelerating agents for the bleaching agent, the type and concentration of the accelerating agents, if included, the duration of bleaching, the temperature of the bleach/fix bath, the speed and nature of relative movement of the emulsion and the bath, the size and type of silver halide grain in the emulsion, the constitution and thickness of the carrier in the emulsion, the developing agent used, the morphology of the metallic silver, etc.

To carry out the invention, the bleaching rate of the bleach/fix bath and the time and conditions of exposure of the emulsion to the bleach/fix bath are so adjusted with respect to the type of black and white emulsion that fog is substantially reduced or essentially eliminated without noticeably visually reducing the density of the areas of heavier density. It is not feasible to assign meaningful ranges of figures to the concentrations of the bleaching agent or the time that an emulsion is subjected to bleaching after development in view of the many variable parameters and the many types of emulsion the photographic processing of which are improved by use of the present invention. However, as a rule of thumb, it has been observed that the best results are obtained in accordance with the invention where the reduction in $d_{max}$ does not exceed 10%, and preferably is less, e.g. less than 5%, for all films except lithographic films which as a practical matter do not have a readily measurable $d_{max}$, and for lithographic films where the reduction of speed does not exceed 25% and preferably is less, e.g. less than 15%. The foregoing figures constitute a practical guideline to the practice of the present invention; however the reduction in density may exceed these figures in some applications, in which event the density losses are compensated for by reformulation of the developer to a higher activity level.

Although there is no certainty as to the theory of operation of the present invention, it is believed that the present invention is effective because of the unique morphology of metallic silver grains formed in a film upon development. It is known that in the development of silver halide emulsions which have been differentially exposed to light, metallic silver at an early state takes on the physical configuration of minute filaments. Some filaments are spaced apart and others are close together. The filaments grow in length, number and thickness as development proceeds, depending upon the degree of exposure, and trace out random twisting paths. Moreover, as development proceeds still further, the filaments interlace and intertwine with one another ultimately forming rather dense masses which, if the exposure is substantial, approximate the shapes of the original silver halide grains. If the exposure is minimal or essentially non-existant the metallic silver formed due to random factors does not create dense masses but remains basically filamentary. It is conjectured that when an emulsion containing such developed metallic silver is subjected to the action of a bleach the attack preferentially takes place where the filaments are spaced further apart, as in the areas of low density (fog areas) and are more accessible to the dissolved bleaching chemical which is permeating the emulsion. Hence, if this theory is correct, where the density of the developed silver is quite small, as it is in areas containing fog, the fog will be more rapidly attacked than where the silver filaments are present as dense masses which are not as readily susceptible to bleaching attacks. It is to be understood that the present invention is not to be restricted to the foregoing theory which is still only a belief.

The preferred bleaching agent is a metal having plural valance states, which metal is present as a bleaching agent in a higher valance state and changes to a lower valance state upon oxidation thereby of metallic silver filaments. An excellent metal for this purpose is iron in its ferric state. Another usable metal is cobalt in its cobaltic state. However, when such a bleaching metal is present in its higher valance state it is difficult to employ in a commercial photographic processing technique because in the presence of thiosulfate ions the mixture is highly unstable. It is known, however, that such higher valance states of the metal may be stabilized by chelating agents and therefore, pursuant to the present invention, the bleach/fix solution is preferably composed of a combination of a thiosulfate salt and a chelated salt of the bleaching metal in its higher valance state. Furthermore, it is desirable to accelerate the bleaching action of the bleaching agent, and this is accomplished by adding a bleaching accelerating agent to the bleach/fix bath.

It should be mentioned that bleach/fix baths are not, per se, novel. It is known that bleach/fix baths containing a combination of a ferric salt, e.g. ferric ethylenediamine-tetraacetic acid, and a fixing agent, e.g. an alkaline thiosulfate, have been used in connection with color photographic processing, the purpose of the bleach/fix bath having been to completely remove a silver image after such image, during development, has been utilized in the formation of color images, and the presence of which deleteriously affected fidelity of color or prevented a transparency from showing colors in their proper values. However, in such use of a bleach/fix bath the bleaching has been uncontrolled in the sense that the silver image was fully bleached out to the point where essentially no metallic silver remained; this is quite unlike the present invention in which the bleaching is controlled, the metallic silver only in the areas of very low density being substantially reduced or eliminated and the metallic silver in the areas of heavier density being visibly materially unchanged.

It also has been known to use a bleaching solution known as "farmer's reducer" in which a bleaching agent was employed in the presence of a small quantity of an alkaline thiosulfate. Farmer's reducer has been utilized solely for reducing density of a black and white image that previously has been fully photographically processed. The bleaching with farmer's reducer was uncontrolled in the sense that the bleaching attack was made on the areas of heavier density and was quite substantial. The result of such bleaching was to reduce contrast because of the reduction in density in the areas of heavier density. The amount of thiosulfate present was quantitatively small compared to the amount present in a bleach/fix solution because the emulsion to which farmer's reducer was applied was a previously fully photographically processed emulsion, which is to say, an emulsion that had been previously developed and fixed so that the alkaline thiosulfate present in farmer's reducer was not present for the purpose of fixing, but rather for the purpose of assisting solubilization of the reaction product of metallic silver with the bleaching agent. Treatment with farmer's reducer is readily distinguishable from photographic processing in accordance with the present invention in that a farmer's reducer treatment does not immediately follow development and in that a farmer's reducer treatment decreases contrast, whereas the photographic processing of the present invention employs the bleach/fix bath immediately after the developing bath and performs the fixing concurrently with the bleaching and, moreover, and of very substantial functional importance, treatment according to the present invention increases rather than decreases contrast and is solely aimed at a controlled bleaching which substantially eliminates metallic silver in the areas of very low density where fog otherwise would be visible and where haze otherwise would interfere with examination of a radiograph, without materially affecting the density of areas of higher density.

The invention accordingly consists in the series of steps which will be exemplified in the methods hereinafter described and of which the scope of application will be indicated in the appended claims.

PREFERRED EMBODIMENTS OF THE INVENTION

The present invention resides in a two-step black and white photographing processing of black and white emulsions in which the first step is a conventional black and white developing step and in which the second step immediately follows the first step, the second step constituting treatment in a bleach/fix bath containing an alkaline fixing agent, a chelated salt of a metal having plural valance states which metal is present in a higher valance state, e.g. a chelated ferric or cobaltic salt, an accelerating agent for the bleaching agent such, for example, as a thiourea, a substituted thiourea or a cyclic thiourea, as well as, optionally, other addenda such, for instance, as an acidic pH buffering agent, an anti-oxidant to inhibit sulfurization, a hardener, a sequestrant, a wetting agent, water, etc. The freshly developed and yet unfixed emulsion is treated in the bleach/fix bath for a period of time which, depending upon the prevailing conditions, permits bleaching to be carried out only to the extent that the metallic silver in areas of very low density are substantially attacked to the point where such silver is totally eliminated or greatly reduced, while at the same time the metallic silver in the areas of heavier density are not visually noticeably affected.

The variation in prevailing conditions can be so extensive that it would be meaningless to specify any particular concentration of a given bleaching agent or particular time for subjection of the developed black and white emulsion to the bleaching agent. Thus, developed silver in certain emulsions is more prone to attack by a bleaching agent and, therefore, can only be bleached to obtain the result of the present invention in shorter periods of time than other emulsions; as the concentration of bleaching agent is increased, the length of time of treatment in the bleaching agent for accomplishing the present invention is reduced; as the thickness of the emulsion varies, the requisite duration of exposure to a given concentration of a given bleaching agent will correspondingly vary; as the density of silver halide grains per unit area and volume of the emulsion varies, so will the time of bleaching for a given concentration of a given bleaching agent vary; moreover, as the time of exposure varies and as the time of development varies and as the specific developing agent used varies, so will the time required for a given bleaching agent to affect the present invention vary; still further, as different bleaching accelerating agents are employed and as these accelerating agents are included in different concentrations, a variation in the time required for a given bleaching agent in a given concentration to achieve the results of the present invention will vary; other factors that affect the activity of the bleaching agent in the practice of the invention are the temperature of the bleach/fix bath, the size of the silver halide grains in the black and white emulsion and the pH of the bleach/fix bath.

Hence, the best appraisal that can be assigned as a criterion of accomplishment of the present invention is a visual one. For any given set of parameters for a specific two-step black and white process employing the present invention, the photographically processed black and white emulsion, i.e. developed, bleached and fixed emulsion, is visually scrutinized to ascertain at what point the areas of very low density, where fog and haze otherwise would be apparent, disappear upon changes in concentration of the bleaching agent and accelerating agent, if the latter is employed, and changes in time and temperature of treatment in the bleach/fix bath, these being the most easily varied parameters inasmuch as the other parameters mentioned usually will be difficult to change or are fixed in some circumstances.

If a plot of the D log E curve is observed for different concentrations of constituents and times and temperatures of bleach/fixing, it will be observed that at a given concentration, temperature and time, with other parameters remaining constant, the toe of the aforesaid curve is materially attacked while the balance of the curve remains largely unchanged, thus indicating that the present invention has been achieved which constitutes a controlled enhancement of the image by selective attack on areas of low density and a minimal attack on areas of heavier density. As indicated previously, it is believed that this controlled bleaching is due to the selective bleaching of metallic filamentary silver wherein the filaments are not yet highly twisted and tangled and intermeshed so as to render these filaments, which are the filaments defining the areas of very low density, more prone to attack by the bleaching agent which has penetrated the carrier of the emulsion, while concurrently the more intertwined and enmeshed and densely packed metallic silver filaments have not yet been affected to a point where the elimination of portions thereof is noticeable visually.

In order to assist in comprehending the extent of controlled bleaching of an image for enhancement, it is pointed out that the invention is practiced where the concentration of bleaching agent and time and temperature of bleaching are so interrelated that the reduction of the density of $d_{max}$ does not exceed 10% and preferably is less, e.g. 5% or less, in the case of silver halide emulsions other than lithographic emulsions and in the case of lithographic emulsions which are not considered in terms of $d_{max}$ but rather in terms of emulsion speed where the emulsion speed is not reduced more than 25% and preferably less, for example, less than 15%.

It also should be mentioned that with respect to haze, it has been observed that even where the fog, after treatment with the present invention, is still measurable with a densitometer so that some fog remains, treatment in the bleach/fix pursuant to the invention considerably clears the haze so that there is a marked difference in appearance when a radiograph treated pursuant to the present invention is held to the light in contrast to a radiograph which is treated with a conventional two-step black and white photographic process in which the fixing bath does not include a bleaching agent. Pursuant to the invention the time of treatment in the bleach/fix bath is much shorter than the time of treatment in a bleach/fix bath for silver removal in color developing processing with equal activity of a bleaching agent. For example, in a black and white two-step photographic process in accordance with the present invention, as compared to a complete silver bleach-out fixing bath in color processing, the time is in the vicinity of 1/10 to 1/50 of that required for color.

As of assistance in practicing the invention, where the bleaching agent is a ferric salt excellent results have been obtained where the ferric salt is present in the form of an alkaline chelated ferric salt ranging from about 0.5 to about 5.0 grams of ferric ion per liter, and also in the presence of an accelerating agent such as thiourea with a bleach/fix time of the same order of magnitude as the developing time.

As of further assistance in teaching the practice of the invention, examples are set forth hereinafter of two-step black and white photographic processing on different types of films with developing agents and specific bleach/fix baths with given times, temperatures and pH's. It will be seen that, typically, the time in the bleach/fix bath for photographic print paper and for reprographic paper is about equal to the time for development and is about 1 to 2 minutes at 68° to 80° F., while for X-ray film of the rapid double coated variety the time in a bleach/fix manual tank bath is about 1 to 2 minutes at 68° to 80° F. for carrying out the invention. Where development is with a roller transport machine such, for example, as the M6 X-O-MAT sold by Eastman Kodak Co. of Rochester, New York, the time in the bleach/fix bath is 15 seconds compared to a development time of 20 seconds. Where a roller transport machine for X-rays is run in a double capacity cycle, the time in the bleach/fix bath is 35 seconds and the time in the developing bath is 70 seconds. It will be appreciated and it will be seen subsequently in the descriptions of various examples that the time in the M6 X-O-MAT is 90 seconds "dry-to-dry" (from time of feed-in to time of feed-out), the temperature being for the liquid treatment steps about 95° F. Insofar as the double capacity cycle is concerned, the dry-to-dry time is approximately 3½ minutes and the temperature about 80° F.

Where lithographic photomechanical film is treated in accordance with the present invention, as will be detailed hereinafter, and in order to assist in understanding the parameters which exemplify proper functioning of the invention, the time in the developer is 2 minutes and the time in the bleach/fix bath likewise is 2 minutes, both at 68° to 75° F., this being for manual handling. In a roller transport machine shorter times can be used, the time in the developer and in the bleach/fix bath ranging from about 1 minute to 2 minutes at approximately 80° F.

Typical alkaline oxidizing salts of metals associated with chelating agents and usable in the present invention include the following: an alkaline salt of ferric ethylenediaminetetraacetic acid, an alkaline salt of ferric hydroxyethylethylenediaminetriacetic acid, an alkaline salt of ferric ethylenediamine-o-hydroxyphenylacetic acid, an alkaline salt of ferric diethylenetriaminepentaacetic acid, an alkaline salt of ferric ortho-diamine cyclohexane tetraacetic acid, an alkaline salt of ferric ethylene glycol bis (aminoethyl ether) tetraacetic acid, an alkaline salt of ferric diaminopropanol tetraacetic acid, and an alkaline salt of ferric ethyliminodipropionic acid, all of the foregoing being alkaline ferric salts of polyaminocarboxylic acid chelating agents and alkaline ferric salts of aminopolycarboxylic acid chelating agents in which the ferric ion is available in a chelated stabilized form. The term "alkaline" as used herein includes sodium, potassium, ammonium, amine, quaternary ammonium and similar alkaline moieties.

In addition to emplying polyaminocarboxylic acids and aminopolycarboxylic acids as chelating agents, the invention also can be achieved with the aid of other acids of phosphorous oxides, such as phosphonic acids, as chelating agents. Typical alkaline ferric salts so chelated are an alkaline salt of ferric 2-hydroxy-1, 3-propylenediaminetetraacetic acid, an alkaline salt of ferric hydroxyethanediphosphonic acid and an alkaline salt of ferric nitrilotrimethylenephosphonic acid.

As mentioned above, metals having plural valance states can be used in place of iron where the metal used in combination with a chelating agent is in a higher valance state, a typical such metal being cobalt and the cobalt being in cobaltic form as a bleaching agent. All of the aforementioned chelated bleaching agents which include iron in its ferric state, can be used with the iron replaced by cobalt in its cobaltic state in the practice of the present invention.

The concentrations of the ferric ion present in the form of a moiety of an alkaline ferric chelated bleaching agent can, vary from about one gram per liter to the limit of solubility of the bleaching agent in the bleach/fix solution in the carrying out of the invention, it being understood that a variation of this concentration will, at a given temperature, requires an inverse variation of the time of treatment to accomplish the low level bleaching action required by the teachings of the present invention. In other words, when the amount of ferric ion present is increased, the time in the bleach/fix bath to secure the small amount of bleaching pursuant to the present invention is reduced.

It also will be apparent to persons skilled in the art that with increased temperatures of the bleach/fix bath either the time in the bath or the concentration of the ferric or cobaltic ion, or both, in proper balance, should be reduced, again to effect only the mild bleaching action called for by the present invention which is sufficient to depress only the toe of the D log E curve without substantially affecting the other parts of the curve and the $d_{max}$ value.

Furthermore, in carrying out the invention it is desirable to incorporate a potentiating agent for the bleaching agent which will accelerate the bleaching action. Typical bleaching accelerating agents are thiourea, substituted thioureas and cyclic thioureas.

By way of example, substituted thioureas useful in the practice of the invention include N-hydroxyethylthiourea, N,N'-di (hydroxyethyl)thiourea, N-sulfoalkylthiourea, N-(2,3-dihydroxypropyl)thiourea, N,N'-di(2,3-dihydroxypropyl)thiourea,

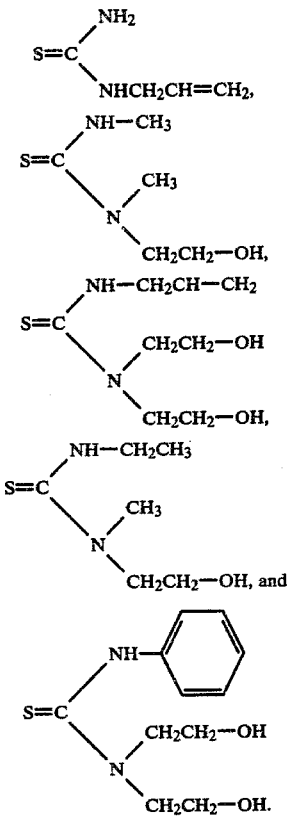

Likewise, by way of example, cyclic thioureas useful in the practice of the invention include ethylenethiourea, 2-hydroxypropylenethiourea,

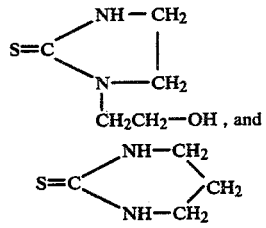

Other accelerating agents useful in the practice of the invention, but which do not accelerate the bleaching action to the same degree, are polyethylene glycols. Any single accelerating agent can be used by itself or combinations of accelerating agents may be employed.

The accelerating agents employed should be soluble in the bleach/fix bath which is an aqueous bath. Preferably, the bleach/fix bath has an acidic pH. The chelated bleaching agents utilized likewise should be soluble in the bleach/fix bath.

The amount of accelerating agent employed in the bleach/fix bath can vary widely, depending upon the particular parameters of the bleach/fix step and the particular accelerating agent used. Under some conditions no accelerating agent at all is necessary; the chelated bleaching agent may be sufficiently active at the temperature and time used for fixing to secure the desired amount of bleaching without acceleration. Conversely, if the time in the bleach/fix bath is to be quite short and the temperature comparatively low, e.g. room temperature or possibly lower, the amount of accelerating agent used may be increased, always with the end result in mind that the bleaching which takes place during the fixing step must only be sufficient to substantially reduce the amount of silver present in substantially unexposed areas of the emulsion and not materially visually reduce the silver in areas of heavier density. However, by way of example, and as a guide, the amount of thiourea employed in a typical bleach/fix bath, where the chelated bleaching agent is sodium ferric hydroxyethylenediaminetriacetate in an amount of 20 grams per liter, is 5 grams per liter where the expected bleach/fix time is about 1½ minutes at about 68° F.

The usual addenda commonly present in bleach/fix baths also can be included, depending upon the particular nature of treatment desired, particular type of emulsion to be treated or the grain size of the silver halide therein, and additional functions the bath is to have, if any. Typical such addenda include anti-oxidants, sulfurization inhibitors, sequestrants, hardeners and pH buffering systems.

Any conventional fixing agent may be employed, a satisfactory one being ammonium thiosulfate, and a suitable range for this particular thiosulfate is from about 50 grams per liter to about 150 grams per liter.

Frequent mention has been made heretofore about the fact that pursuant to the present invention the density or sensitivity (if a lithographic emulsion) of the silver in the areas of heavier density, such as $d_{max}$, should not be materially reduced, the largest permissible reduction being in the order of 10% for $d_{max}$ and 25% for sensitivity wherelithographic emulsions are concerned. However, it will be appreciated that lesser reductions in density or sensitivity, as the case may be, for the particular emulsion are desirable, these being a maximum 5% reduction of $d_{max}$ and a maximum 15% reduction of sensitivity. As a practical matter, the best results are obtained where the reduction in $d_{max}$ and sensitivity for the different emulsions involved are even smaller, for example, 2% or less for $d_{max}$ and 5% or less for sensitivity; and, indeed, as will be seen from examples hereinafter set forth, in the use of the invention it has been found, unexpectedly, that there is sometimes even an increase in $d_{max}$. The foregoing figures constitute a practical guideline to the practice of the present invention; however, the reduction in density may exceed these figures in some applications in which event the density losses are compensated for by reformulation of the developer to a higher activity level.

The following include examples of bleach/fix baths used in carrying out the invention as well as of processing steps for effecting the desired results of the invention with such baths. The examples given also include comparative baths and processing steps in which a chelated bleaching agent has been omitted so as to provide a fixing bath and process as a control. In some of the examples a chelated bleaching agent has been employed without an accelerating agent, and in others a potentiating agent and a chelated bleaching agent have been used in combinations.

EXAMPLE 1

| Constituents | A | B | C |
|---|---|---|---|
| Ammonium thiosulfate (58% by weight in water) | 260.0 g. | 260.0 g. | 260.0 g. |
| Sodium sulfite (alkaline sulfite anti-oxidant sulfurization inhibitor) | 20.0 g. | 20.0 g. | 20.0 g. |
| Sodium hydroxide (pH buffering system) | 5.0 g. | 5.0 g. | 5.0 g. |
| Acetic acid to pH (pH buffering system) | 4.45 | 4.45 | 4.45 |
| Citric acid (sequestrant) | 3.5 g. | 3.5 g. | 3.5 g. |
| Aluminum sulfate (37% by weight in water-hardener) | 66.5 g. | 66.5 g. | 66.5 g. |
| Sodium ferric hydroxyethylethylenediaminetriacetate (31.7% by weight in water) | 0 | 20.0 g. | 20.0 g. |
| Thiourea | 0 | 0 | 5.0 g. |
| Water to | 1 liter | 1 liter | 1 liter |

It will be observed that EXAMPLE 1-A is an essentially standard fixing bath, EXAMPLE 1-B differs from EXAMPLE 1-A in that it employs a chelated ferric bleaching agent but no accelerating agent thereby embodying a bleach/fix bath used in carrying out the present invention, and EXAMPLE 1-C include both a chelated ferric bleaching agent and an accelerating agent thereby embodying a bleach/fix bath for carrying out another form of process of the present invention.

Three strips of Eastman Kodak Kodabromide grade F-2 photographic paper were exposed through a conventional stepped density scale. All three strips were developed in a conventional photographic paper developer which was an Eastman Kodak D-72 developer at a 1:2 dilution at 68° F. for 90 seconds. Immediately following the development step each strip was fixed, the first strip, denominated strip A, being fixed in solution 1-A, the second strip, denominated strip B, being fixed in solution 1-B, and the third strip, denominated strip C, being fixed in solution 1-C. All fixing times were identical, to wit, 90 seconds, and all fixing temperatures were identical, to wit, 68° F. Immediately after each strip was fixed it was washed and dried by conventional methods. Density measurements were taken of the exposed and developed strips and on the basis of the measurements D log E curves for each strip were plotted and gammas measured. Set forth below is a tabulation of the contrast (gamma) measurements and of the density of certain of the steps measured, these steps being in the area of the visual threshold:

| Example | Gamma | 10th step | 11th step | $d_{max}$ |
|---|---|---|---|---|
| Strip A | 2.08 | 0.30 | 0.52 | 1.87 |
| Strip B | 2.14 | 0.10 | 0.30 | 2.04 |
| Strip C | 2.72 | 0.10 | 0.12 | 2.14 |

As can be seen from this data, when a chelated bleaching agent was added to a conventional fixing bath some increase in contrast was obtained and there was a substantial reduction of fog at the visual threshold. There was also an increase in $d_{max}$. When an accelerating agent was used in addition to the chelated bleaching agent, the contrast increased by a substantial amount, thus effecting a material enhancement of the black and white image. Moreover, in the area of the visual threshold at the 11th step density was markedly reduced. Additionally, $d_{max}$ was further increased, the same representing a substantial increase over $d_{max}$ for the strip treated in a fixing bath without any chelated bleaching agent. Similar results were obtained with other chelated bleaching agents and other accelerating agents. It will be noted that the same concentration of chelated bleaching agent was used in both bleach/fix baths 1-B and 1-C, showing the substantial superadditive effect of the accelerating agent to the action of the bleaching agent.

EXAMPLE 2

The same three baths were used as given above in EXAMPLE 1, to wit, baths 1-A, 1-B and 1-C. However, the three strips of paper employed were Photostat NM reproduction paper which are reproduction papers for high contrast continuous tone types of images. The three strips 2-A, 2-B and 2-C were exposed in the same manner as the three strips A, B and C treated in Example 1.

The three strips 2-A, 2-B and 2-C were exposed through a stepped density scale and then were developed in a conventional reprographic developer, for example, Hunt GRAPH-O-STAT developer, diluted with seven parts by volume of water, at 68° F. for 90 seconds. Immediately after developing, the three strips were fixed at 68° F. for 90 seconds in the three solutions 1-A, 1-B and 1-C described with respect to EXAMPLE 1. The developed and fixed strips were washed and dried conventionally.

Set forth below is a tabulation of the contrast (gamma) measurements and the densities of certain of the steps measured, these steps being in the area of the visual threshold:

| Example | Gamma | 11th step | 12th step | $d_{max}$ |
|---|---|---|---|---|
| Strip 2-A | 1.88 | 0.31 | 0.49 | 1.38 |
| Strip 2-B | 2.04 | 0.09 | 0.39 | 1.42 |
| Strip 2-C | 2.28 | 0.09 | 0.14 | 1.50 |

The observations made in connection with EXAMPLE 1 and the results obtained therefrom are similarly true of Examples 2-A, 2-B and 2-C.

EXAMPLE 3

In order to show the effect of the invention in connection with the treatment of X-ray film, three strips 3-A, 3-B and 3-C of Eastman Kodak rapid processing (RP)-54 X-ray film were exposed through a stepped density scale and developed by hand in a tank containing a conventional manual X-ray developer, to wit, Hunt Liquid X-Ray Developer, diluted with three parts by volume of water, at 80° F. for 90 seconds. Each of the three strips was fixed in a different one of the same three bleach/fix baths 1-A, 1-B and 1-C as described in connection with EXAMPLE 1, the treatment being carried out by hand in a tank at 80° F. for 90 seconds.

The following is a tabulation of the base+fog levels obtained after use of the three baths as well as the densities at the 6th and 7th steps and at $d_{max}$, said steps being at the toe of the D log E curve:

| Example | Base + Fog | 6th step | 7th step | $d_{max}$ |
|---|---|---|---|---|
| Strip 3-A | 0.24 | 0.57 | 0.72 | 3.00 |
| Strip 3-B | 0.22 | 0.49 | 0.66 | 2.83 |
| Strip 3-C | 0.19 | 0.40 | 0.54 | 3.04 |

Once again, the effect of practicing the invention is quite clear. The addition of the chelated bleaching agent alone to the fixing bath reduces the base+fog and the further addition of the accelerating agent has substantially decreased the base+fog level by approximately 20%. It must be remembered that this decrease is at the unexposed areas and that the base+fog level resulting from the use of the bleach/fix bath in accordance with the invention has reduced the density of the background to a point where fog has essentially been removed and only base density remains. This makes the X-ray considerably easier to read.

Furthermore, the ease of reading the X-ray film has been substantially increased by reducing the density level at the 6th and 7th steps adjacent the toe of the D log E curve so that the contrast at the low levels of density has been substantially increased. It will be seen that there is a difference in density of 0.15 between the 6th and 7th level using a conventional fixer while there is substantially the same difference in density at the 6th and 7th level using the bleach/fixer embodying a chelated bleaching agent and agent in accordance with the present invention. However, this same reduction in density now is occurring at a lower level of overall density so that the increase in contrast between the 6th and 7th step has been rather substantially increased. This makes it far easier for a radiologist to read and interpret an X-ray in areas which formerly were difficult to read and interpret such, for example, as an examination of mild calcification or view information in soft tissue areas. A radiologist experiences little difficulty in connection with interpretation of solid bone masses. It is in the areas of low density differences, such as those indicated above, that differences in interpretation arise. Interpretation of such areas is quite critical for the understanding of many physiological conditions, for example, early detection of cancer where the shadows are of such low density differences that it is quite important to increase the contrast thereof with respect to that of surrounding areas even if the absolute density of the shadow is somewhat reduced. It also will be observed that this beneficial effect secured by the processing of the instant invention has been obtained with minimal reduction of $d_{max}$ and, indeed, in the case of the combination of the accelerating agent and the fixing agent, with a very slight increase in $d_{max}$.

In the three examples given above it will be seen that $d_{max}$ has increased despite the fact that the freshly developed image has been subjected during the fixing step to a bleaching action in the presence of an accelerating agent. This was entirely unexpected and inexplicable. It is theorized that a true reduction in density at the area of greatest exposure may not take place and that the apparent increase may have been caused by a dramatic alteration of image silver morphology.

It is further observed that although no instrumentality for measuring haze is available insofar as presently is known to the inventor, another characteristic of X-ray film treated pursuant to the present invention by bleaching of freshly developed film while fixing the same is that haze is noticeably reduced, the haze as mentioned earlier being a diffusion of light which is transmitted through an X-ray film. This haze is both distracting to a person reading the film who normally reads the film by transmitted rather than reflected light, and also detracts from the ability of a skilled observer to interpret small differences in density, particularly at the lower areas of density such as those discussed in connection with this third example.

EXAMPLE 4

In this example the process of the invention was tested on a photomechanical reproduction film of the line or screen type, the comparison being between conventional fixing and fixing using a chelated bleaching agent in addition to fixing, but without an accelerating agent. The emulsions on which the tests were performed were two strips of Eastman Kodak Kodalith Type 3 photomechanical film designated 4-A and 4-B. These strips were exposed through a stepped density scale and were identically developed in a high contrast photomechanical developer, to wit, Eastman Kodak D-8 at 68° F. for 2 minutes. The strips then were fixed in the following two fixers, one of which is a conventional fixing bath and the other the same bath with the addition of a chelated bleaching agent. No bath with a potentiating agent was used in this example.

The two fixers were:

| Constituents | A | B |
|---|---|---|
| Ammonium thiosulfate (58% by weight in water) | 260.0 g. | 260.0 g. |
| Sodium sulfite (alkaline sulfite antioxidant sulfurization inhibitor) | 20.0 g. | 20.0 g. |
| Sodium hydroxide (pH buffering system) | 5.0 g. | 5.0 g. |
| Acetic acid to pH (pH buffering system) | 4.45 | 4.45 |
| Citric acid (sequestrant) | 3.5 g. | 3.5 g. |
| Aluminum sulfate (37% by weight in water-hardener) | 66.5 g. | 66.5 g. |
| Sodium ferric hydroxyethylethylenediaminetriacetate (31.7% by weight in water) | 0 | 40.0 g. |
| Thiourea | 0 | 0 |
| Water to | 1 liter | 1 liter |

Conventional washing and drying followed fixing.

The following is a tabulation of the base+fog, average toe contrast*and 5th, 6th and 7th density steps at the visual threshold obtained with the above fixers:

| Example | Base + Fog | Average Toe Contrast | 5th step | 6th step | 7th step |
|---|---|---|---|---|---|
| Strip 4-A | 0.13 | 2.56 | 0.20 | 0.37 | 0.80 |
| Strip 4-B | 0.03 | 3.80 | 0.03 | 0.06 | 0.19 |

*Average toe contrast is the tangent of the slope of a line drawn between two points on the D log E curve one of which is at a density of 0.10 above base+fog and the other at a density of 1.00 above base+fog, this measurement having been observed to be an excellent indication of the quality of toe contrast in photomechanical films.

The foregoing data indicates that the use of a chelated bleaching agent, even in the absence of an accelerating agent in the fixer substantially decreases base+fog (from 0.13 to 0.03) as well as increases average toe contrast from a low 2.56 to a high 3.80 while very substantially depressing the low end of the D log E curve in the vicinity of the visual threshold.

Although it has not been specifically stated above, it will be understood by those skilled in the art that the emulsions above mentioned upon which the foregoing treatment steps pursuant to the present invention have been practiced are black and white emulsions and that the developers are black and white developers, so that the developed and fixed images are black and white images. The steps of the present invention are useless for treatment of color film because color is developed as a concomitant of silver grain development and the entire silver image must be removed during the bleaching step in contradistinction to the present invention where it is essential that the silver image remain because this is the only thing that can be seen in a black and white image. What in fact the present invention accomplishes is a selective reduction of density in the low density areas with a minimal and essentially unnoticeable reduction in density in heavier density areas and a minimal reduction in density of $d_{max}$.

EXAMPLE 5

This example has been given to illustrate the use of the present invention in connection with different brands of X-ray films. In each instance a control has been employed for each film which control is a fixing bath with no chelated bleaching agent. Three baths were prepared of the following compositions:

| Constituents | A | B | C |
|---|---|---|---|
| Ammonium thiosulfate (58% by weight in water) | 260.0 g. | 260.0 g. | 260.0 g. |
| Sodium sulfite (alkaline sulfite anti-oxidant sulfurization inhibitor) | 20.0 g. | 20.0 g. | 20.0 g. |
| Sodium hydroxide (50% by weight in water) } pH buffering system | 10.0 g. | 10.0 g. | 10.0 g. |
| Acetic acid to pH } pH buffering system | 4.45 | 4.45 | 4.45 |
| Citric acid (sequestrant) | 3.5 g. | 3.5 g. | 3.5 g. |
| Aluminum sulfate (37% by weight in water-hardener) | 40.0 g. | 40.0 g. | 40.0 g. |
| Sodium ferric ethylenediaminetetraacetate (31.7% by weight in water) | 0 | 10.0 g. | 10.0 g. |
| Thiourea | 0 | 0 | 5.0 g. |
| Water to | 1 liter | 1 liter | 1 liter |

Seven different brands of X-ray films were employed, each subdivided into three strips. Each strip was exposed through a stepped density scale and was developed with the same developer as mentioned for EXAMPLE 3. Immediately after development a different strip of each film brand was fixed in each of the three above different fixing solutions. Each of the strips was conventionally washed and dried. Development and fixing were carried out in roller transport machines. Two machines were used. One was an Eastman Kodak M6 X-O-MAT with a 90 second dry-to-dry cycle in which the developing was for 20 seconds, the fixing for 15 seconds and the washing for 10 seconds, all at about 94° F. The other machine was a modified Eastman Kodak M-6 X-O-MAT with a 3 and one-half minute dry-to-dry cycle, the developing time being 70 seconds, the fixing time being 35 seconds and the washing time being 35 seconds, all at about 80° F. All the strips had their densities measured by a densitometer. The table below gives the base+fog measurements for the strips treated with the different bleach/fix solutions, the same results being secured with both the 90 second cycle and the 3 and one-half minute cycle:

| Film Brand | A | B | C |
|---|---|---|---|
| Eastman Kodak RP-L | 0.22 | 0.19 | 0.17 |
| Eastman Kodak RP-54 | 0.21 | 0.17 | 0.14 |
| GAF HR-2000 | 0.22 | 0.22 | 0.14 |
| GAF HR-3000 | 0.21 | 0.21 | 0.16 |
| Dupont Cronex 4 | 0.24 | 0.24 | 0.22 |
| Dupont Cronex 6 | 0.25 | 0.24 | 0.21 |
| Dupont Cronex II-DC | 0.25 | — | 0.15 |

EXAMPLE 6

This example has been given to illustrate the use of the present invention in connection with different photomechanical films, in each instance a control being used in which no chelated bleaching agent was employed. Two baths were prepared with the following compositions:

| Constituent | A | B |
|---|---|---|
| Ammonium thiosulfate (58% by weight in water) | 260.0 g. | 260.0 g. |
| Sodium sulfite (alkaline sulfite anti-oxidant sulfurization inhibitor) | 20.0 g. | 20.0 g. |
| Sodium hydroxide (50% by weight in water) } pH buffering system | 20.0 g. | 20.4 g. |
| Acetic acid to pH } pH buffering system | 5.00 | 5.00 |
| Citric acid (sequestrant) | 3.5 g. | 3.5 g. |

| Constituent | A | B |
|---|---|---|
| Aluminum sulfate (37% by weight in water-hardener) | 40.0 g. | 40.0 g. |
| Sodium ferric ethylenediaminetetraacetate (13% by weight in water) | 0 | 10.0 g. |
| Water to | 1 liter | 1 liter |

Three different commercial brands of photomechanical films were employed, each subdivided into two strips. Each strip was exposed through a stepped density scale and was developed with the same developer as mentioned in EXAMPLE 4. Immediately after development a different strip of each film was fixed in each of the two different fixing baths described above. Each of the strips was conventionally washed and dried. Development and fixing were carried out at 80° F. for 90 seconds. All strips had their densities measured by a densitometer. The table below gives the average toe contrast for each of the three mentioned commercial brands photomechanical films processed with the different bleach/fix solutions:

| Film | A | B |
|---|---|---|
| 3M Lithograph Ortho | 1.65 | 3.80 |
| GAF Reprolith | 1.94 | 2.96 |
| Eastman Kodak Kodalith Type 3 | 4.50 | 5.20 |

The very substantial increase in average toe contrast is evident.

It thus will be seen that there are provided methods which achieve the various objects of the invention and which are well adapted to meet the conditions of practical use.

As various possible embodiments might be made of the above invention, and as various changes might be made in the embodiments above set forth, it is to be understood that all matter herein described is to be interpreted as illustrative and not in a limiting sense.

Having thus described the invention there is claimed as new and desired to be secured by Letters Patent:

1. A two-step method of photographic processing for non-lithographic black and white images (I) in which as the first step a latent image in an exposed black and white silver halide emulsion is developed in a developing first bath to form a black and white silver image and (II) in which as the second step the developed emulsion is fixed in an aqueous fixing second bath containing a thiosulfate salt as a fixing agent, wherein the improvement comprises (III) enhancing the developed black and white silver image by controlled bleaching (a) during fixing (i) by including in the second bath an amount of a chelated salt (1) of a metal having plural valance states selected from the group consisting of iron and cobalt, (2) with a chelating acid selected from the group consisting of aminopolycarboxylic acids, polyaminocarboxylic acids and phosphonic acids, (3) the metal being in its higher valance state, (ii) sufficient to greatly reduce the silver in low density areas of the developed black and white silver image (iii) while not substantially affecting areas of heavier density, (iv) and also including in the second bath an agent for accelerating bleaching said agent being selected from the group consisting of thiourea, substituted thioureas, cyclic thioureas and polyethylene glycol.

2. A method as set forth in claim 1 wherein the accelerating agent is selected from the group consisting of thiourea, N-hydroxyethylthiourea, N,N'-di(hydroxyethyl)thiourea, N-sulfoalkylthiourea, N-(2,3-dihydroxypropyl)thiourea, N,N'-di(2,3-dihydroxypropyl)thiourea,

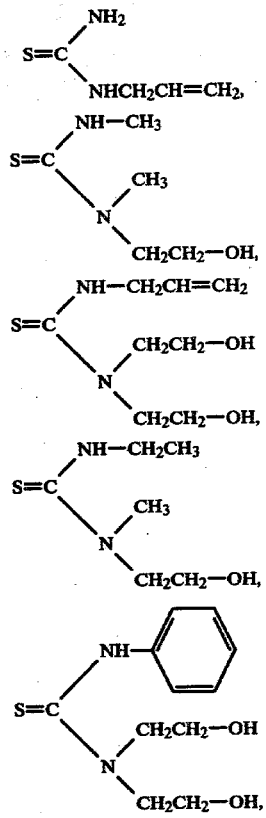

ethylenethiourea, 2-hydroxypropylenethiourea,

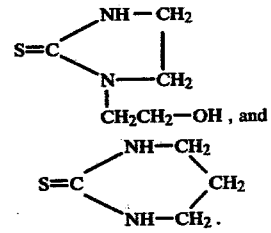

3. A method as set forth in claim 1, wherein the controlled bleaching is such as to depress the toe of the D log E curve obtained with the same development and fixing, but without controlled bleaching, without markedly affecting the balance of said curve.

4. A method as set forth in claim 1 wherein the bleaching is only carried out to a stage at which essentially no metallic silver remains in the areas of minimum density of the developed image, with the metallic silver in the areas of heavier density being optically materially unchanged.

5. A method as set forth in claim 1 wherein the reduction in density of $d_{max}$ at the end of bleaching does not exceed 10%.

6. A method as set forth in claim 1 wherein the reduction in density of $d_{max}$ at the end of bleaching does not exceed 5%.

7. A method as set forth in claim 1 wherein the reduction in density of $d_{max}$ at the end of bleaching does not exceed 2%.

8. A two-step method for forming a black and white non-lithographic silver halide photographic image, which comprises developing an exposed non-lithographic silver halide element with a black and white developer containing a developing agent and a sulfite ion to form a black and white silver image in the element and thereafter fixing said developing agent with a solution containing a ferric ion chelate complex salt oxidizing agent, an agent for accelerating the action of said oxidizing agent, and a thiosulfate fixing agent, said accelerating agent being selected from the group consisting of thiourea, substituted thioureas, cyclic thioureas and polyethylene glycol.

* * * * *